United States Patent [19]

Trumble

[11] Patent Number: 4,907,012

[45] Date of Patent: Mar. 6, 1990

[54] ANTENNA

[75] Inventor: Francis R. Trumble, Maidenhead, England

[73] Assignee: Thorn EMI plc, London, England

[21] Appl. No.: 108,113

[22] Filed: Oct. 14, 1987

[30] Foreign Application Priority Data

Oct. 17, 1986 [GB] United Kingdom ..... 8624984

[51] Int. Cl.[4] ..... H01Q 1/36

[52] U.S. Cl. ..... 343/895; 343/772; 343/776; 343/789; 343/853

[58] Field of Search ..... 343/895, 850, 841, 789, 343/772, 776, 873, 893, 844, 824, 846, 853, 860

[56] References Cited

U.S. PATENT DOCUMENTS

| | | | |
|---|---|---|---|
| 2,597,144 | 5/1952 | Clapp | 343/826 |
| 3,509,572 | 4/1970 | Barbano | 343/846 |
| 4,032,921 | 6/1977 | Sikina, Jr. et al. | 343/895 |
| 4,400,703 | 8/1983 | Shiokawa et al. | 343/895 |
| 4,680,591 | 7/1987 | Axford et al. | 343/895 |
| 4,716,415 | 12/1987 | Kelly | 343/771 |

FOREIGN PATENT DOCUMENTS

| | | | |
|---|---|---|---|
| 0132945 | 2/1985 | European Pat. Off. . | |
| 1234751 | 6/1971 | United Kingdom | 343/895 |

*Primary Examiner*—Rolf Hille
*Assistant Examiner*—Hoanganh Le
*Attorney, Agent, or Firm*—Fleit, Jacobson, Cohn, Price, Holman & Stern

[57] ABSTRACT

An antenna has a resonant cavity defined by electrically conducting plates and a sidewall, and has sixteen helical antenna elements each with five turns in the helical section and a probe at the opposite end, the stem of probe passing through an aperture in upper plate so that its end is within the resonant cavity common to all elements in that module.

The cavity has a cross-section parallel to the plates essentially square in shape except for the presence of four inwardly-protruding buttresses, one situated midway along each side of the cavity to promote the formation of standing waves of different mode, and thereby enhance the frequency range of the array.

8 Claims, 4 Drawing Sheets

ANTENNA

BACKGROUND OF THE INVENTION

The present invention relates to a flat plate antenna, and particularly but not solely to an antenna for the reception of Direct Broadcast Satellite (DBS) television signals.

It is proposed that DBS networks will operate on a carrier frequency of around 12 GHz. Flat plate antennas for this frequency range are made of an array of elements, each element being capable of receiving the 12 GHz signals. Due to the short (2.5 cm) wavelength involved the elements are small in size. To provide sufficient energy for satisfactory television pictures, a large array of elements is needed. For aesthetic reasons this array should not be larger than about one square meter. The received signal from each of these elements has to be guided, in the correct phase relationship, to a common point so that the combined signal can be fed into the front end module of the receiver. However, in the transfer of these individual signals to the common collecting point, a substantial proportion of the signal can be lost.

One form of flat plate antenna, described in European Patent Application Publication No. 132945, has four arrays each having sixteen helical antenna elements with probes located within a common resonant cavity of square cross-section. The cavity is used to combine all the outputs of the elements with very low loss.

SUMMARY OF THE INVENTION

An object of the present invention is to provide a flat plate antenna with good wide-band characteristics.

The present invention provides an antenna module comprising a plurality of antenna elements, each of which is mounted over a support member and is coupled to a common resonant cavity thereby to combine in use the signals received by the elements, the major cross-section of the resonant cavity being parallel to the support member and having a shape formed by a parallelogram having, on at least one side, at least one inwardly-extending buttress.

Preferably, for each buttress located on one side, there is positioned an opposing buttress on the parallel side. Such an arrangement promotes the production of waveforms of a different mode to that appropriate to the dimensions of the parallelogram, which can be combined with those of the designed mode to enhance the frequency range of the array.

Preferably, a buttress has a cross-section, in a plane parallel to the major cross-section of the cavity, substantially rectangular or square in shape.

Preferably, a plurality of columns are located within the resonant cavity and between its two major surfaces, to effect division of the cavity to sections which enhance formation of predetermined wave modes. Moreover, preferably a plurality of columns are located within the resonant cavity and between its two major surfaces, each column at a position intermediate a pair of opposing buttresses on facing sides of the cavity.

Preferably, the antenna elements are arranged on the support member in a square matrix formation; alternatively the antenna elements are arranged on the support member in a rectangular matrix formation.

Preferably, the parallelogram shape of the cavity cross-section is a square.

In one preferred form, an antenna comprises a plurality of antenna modules as described above, and corporate feed means to effect electrical connection of the modules to provide combined operation of the modules.

BRIEF DESCRIPTION OF THE DRAWINGS

In order that the invention may more readily be understood a description is now given, by way of example only, reference being made to the accompanying drawings, in which.

Each of the illustrated antenna modules is designed to be particularly suited for receiving signals of the format intended for use by the Direct Broadcast Satellite (DBS) networks in Europe. Thus each antenna module has elements of helical shape (particularly suited for receiving signals with circular polarization, a characteristic of the DBS signals) and can receive readily signals with frequencies in the region of 12 GHz (this being the approximate value of carrier frequencies to be used by the DBS networks). Each of the antenna modules is constructed in a flat-plate form, in order to maximise the surface area available for signal collection for a given volume used.

DESCRIPTION OF THE PREFERRED EMBODIMENT

Figure 1:
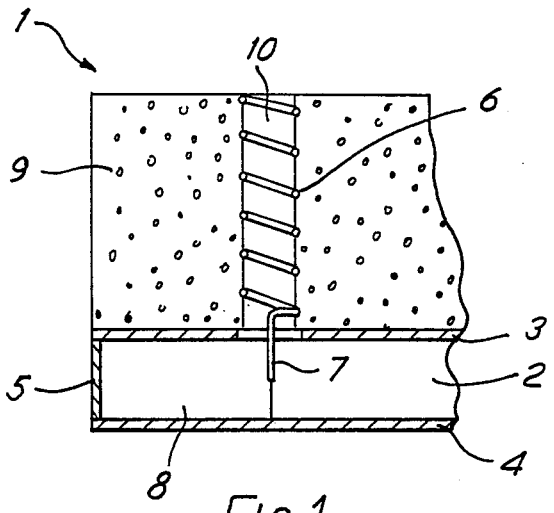
FIG. 1 is a cross-section in elevation of part of an antenna module embodying the present invention.
Figure 2:
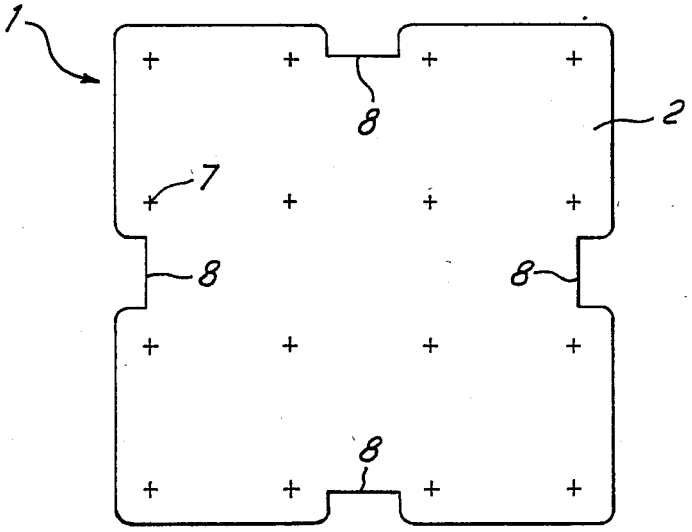
FIG. 2 is a schematic plan view of the cavity of the module of FIG. 1.

Considering now the antenna module partly shown in FIGS. 1 and 2, it has a resonant cavity 2 defined by electrically conducting plates 3, 4 (each 126 mm square and 1.25 mm thick) and a sidewall 5. The module 1 also has sixteen helical antenna elements 6 each with five turns in the helical section and a probe 7 at the opposite end, the stem of probe 7 passing through an aperture in upper plate 3 so that the end of probe 7 is located within the resonant cavity 2 common to all elements 6 in that module. In this way there is an electric coupling between all the elements 6 of the module 1 and electric field antinodes of the cavity 2, such that any electric field signal components received by elements 6 in module 1 are passed into cavity 2; thus the cavity 2 is used to combine all the outputs of elements 6.

Each element 6 has an helical turn exterior diameter of 0.32 λ, a helical pitch of 0.24 λ, and is located such that the junction between the helical portion and the probe is 3 mm above the upper plate 3 and such that the probe penetrates 5 mm into the cavity. The spacing of elements is 1.5 λ.

Figure 3:
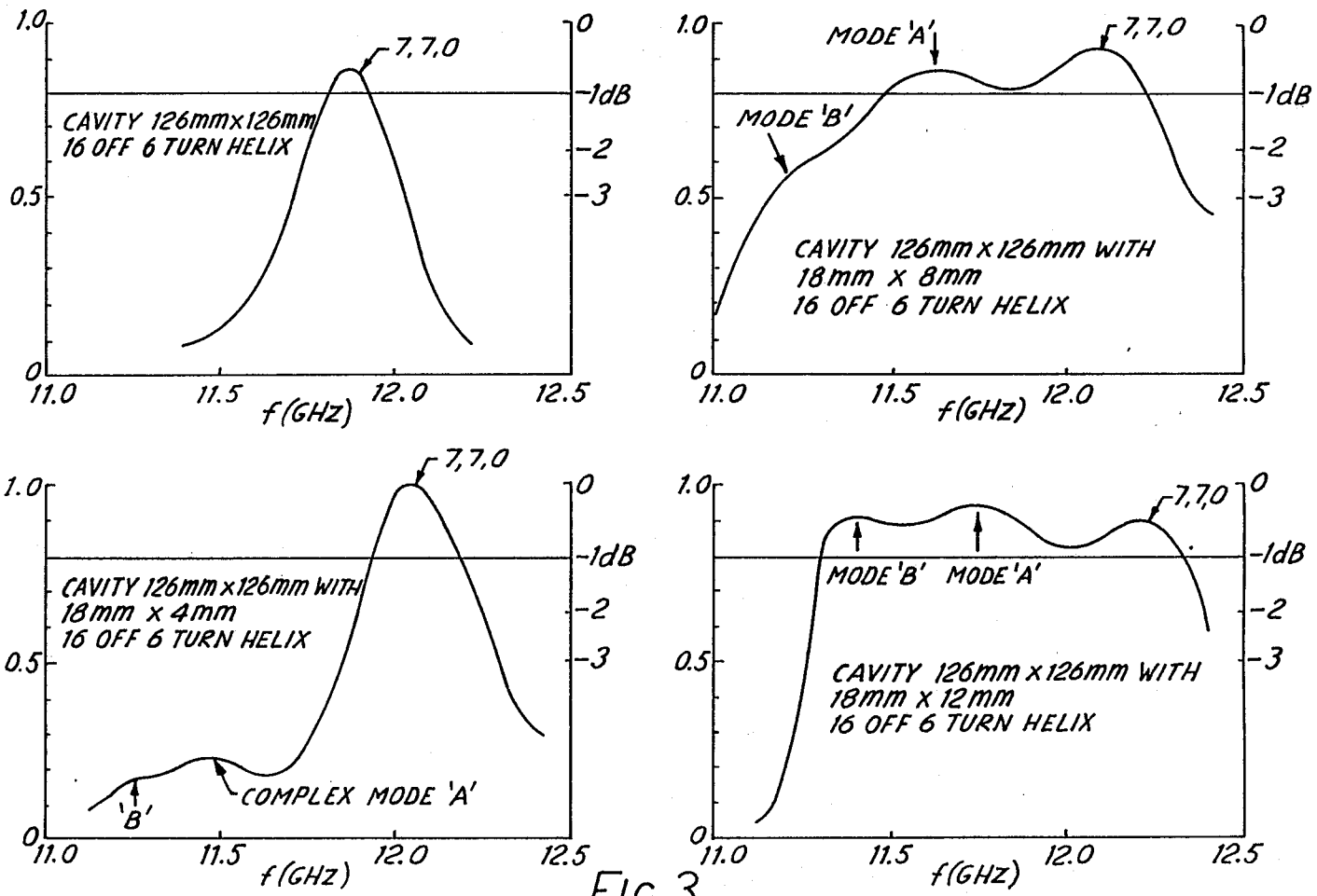
FIG. 3 shows graphs which indicate the significance of buttresses in the module of FIG. 1.

As shown by FIG. 2, cavity 2 has a cross-section (in planes parallel to plates 3,4) essentially square in shape except for the presence of four inwardly-protruding buttresses 8, one situated mid-way along each side of the cavity. The buttresses 8 contact plates 3,4 and promote the formation of standing waves of different mode to that suited to the square dimension of the cavity, and thereby enhance the frequency range of array 1. The significance of this effect is clearly illustrated by comparison between the four graphs A, B, C, D shown in FIG. 3, these indicating the spectral content of received signals for cavities with various sizes of buttress, namely: Graph A corresponds to no buttresses; Graph B to buttresses which protrude 4 mm into the cavity; Graph C to buttresses which protrude 8 mm; and Graph D to buttresses which protrude 12 mm. It can be seen that, with increasing size of buttress, the spectrum of the received signals becomes more multimode, thereby having improved frequency range characteristics; the optimum size is about 12 mm.

The Applicant believes that the effect of the buttresses 8 is due to compression of the field pattern between opposing buttresses. The cavity 1 is designed to function in the 7,7,0 mode. At the higher frequencies this mode can be supported, but at lower frequencies (around 11.3 GHz) fields corresponding to the 5,5,0 mode exist between the buttresses; also a 3,3,0 mode may occur in the central area. Thus various modes are set up in different regions of the cavity. Across the frequency band there is a smooth transition between the different sets of conditions. The relative frequencies and influence of these other modes is principally determined by the degree of protrusion of the buttresses into the cavity. A 1 dB bandwidth in excess of 1 GHz can be achieved at a nominal operating frequency of 11.9 GHz.

The presence of buttresses also gives the structure of the module added strength and rigidity. A body 9 of polystyrene foam material is stuck to upper plate 3, thereby protecting the elements 6. The foam body 9 also acts to hold the elements in position with respect to cavity 2, by virtue of the diameter of the cylindrical holes 10 in the foam being sufficiently less than the exterior diameter of the helical turns of elements 6, thereby causing enough foam deformation to provide a rigid grip. This mounting arrangement is particularly suited to quick and easy assembly in that the helical elements can be loaded into the respective holes 10 and thereafter the foam body 9 is fixed, by adhesive, to upper plate 3.

Figure 4:
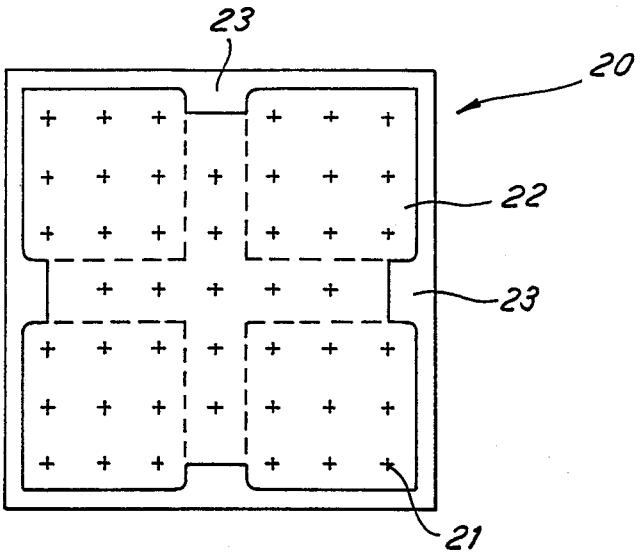
FIG. 4 is a schematic plan view of the cavity of another form of antenna module embodying the present invention.

There is shown in FIG. 4 a plan view of the cavity region of another antenna module 20 embodying the present invention. Except where indicated otherwise, antenna module 20 has the same features as the module described with reference to FIGS. 1 to 3. Module 20 is also designed to operate with a mode corresponding to (7,7,0), so that there are a total of 49 voltage antinodes available for use; accordingly, the helical elements 21 are arranged around cavity 22 such as to utilize as many as possible. The presence of buttresses 23 prevent four of the antinodes from being used, and so a helical element 21 is positioned at each of the remaining 45 antinodes (the locations of the elements being indicated by crosses in FIG. 4). It would appear that, by this arrangement of elements 21 and buttresses 23, the cavity is effectively separated into five regions with respect to the formation of wave modes, namely the four subsquares and the central cross indicated by the broken lines in FIG. 4.

Some of the 49 antinodes are 180° out of phase with the rest, this being compensated for by having the helices at these anti-nodes rotated through 180° thereby providing an output from all the helices in the same phase. Shorter helices (e.g. of 1.5 turns) are used to minimise mutual coupling effects.

Figure 5:
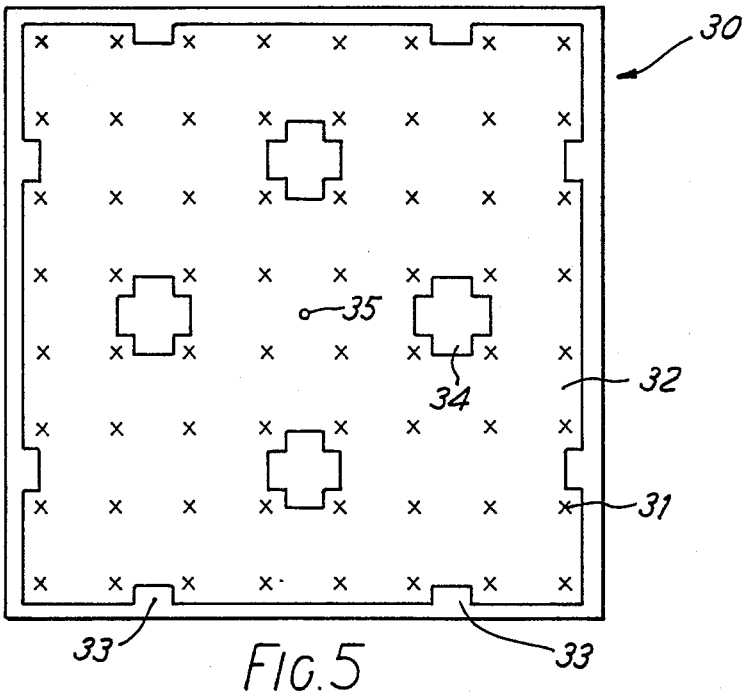
FIG. 5 is a schematic plan view of the cavity of another antenna module embodying the present invention.

FIG. 5 shows a plan view of the cavity for another form of antenna module 30 designed for the (15,15,0) mode, this having sixth-four helical elements 31 in a eight-by-eight square matrix, each side of cavity 32 having two buttresses 33 at positions a quarter and three-quarters way along.

The cavity 32 also has four cruciform columns 34 placed such that each is midway between a pair of opposing buttresses. Each column 34 is electrically conductive and contacts both the upper plate 3 and the lower plate 4; the columns act to effect separation of the cavity 32 into a number of partially-overlapping areas for the formation of multimode waves. Module 30 has a common output feed 35. The presence of the columns gives the structure of the module further strength and rigidity.

Figure 6:
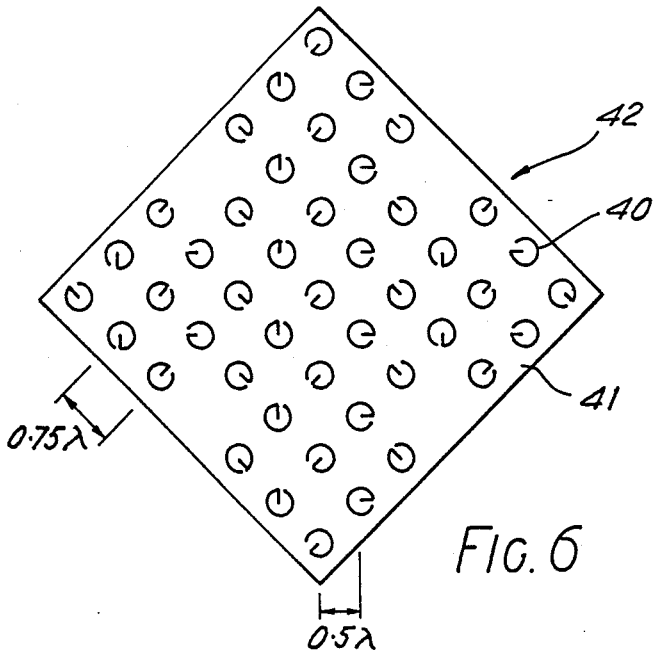
FIGS. 6 and 7 are plan views of different arrangements of helical elements in antenna modules embodying the present invention.

FIG. 6 is a plan view of the arrangement of helical elements 40 on an upper plate 41 for another form of antenna module 42. This arrangement corresponds to rotation of the previously described arrangements through 45°, thereby positioning the diagonals such as to be in the vertical and horizontal directions, so that a different and better distribution of elements is provided in the azimuthal plane. This module 42 has, when only subsquares are used, much reduced side lobes in the azimuth (horizontal) direction, thereby reducing the deleterious effects of non-optimum coupling or mismatches.

In order to provide module 42 with a viewing beam which is inclined at 15° to the normal of its front face (i.e. the module has a squint of 15° in the horizontal direction), the phase of elements 40 are changed in adjacent rows, this being achieved simply by having the helix in an orientation whereby it is rotated through 45°.

Figure 7:
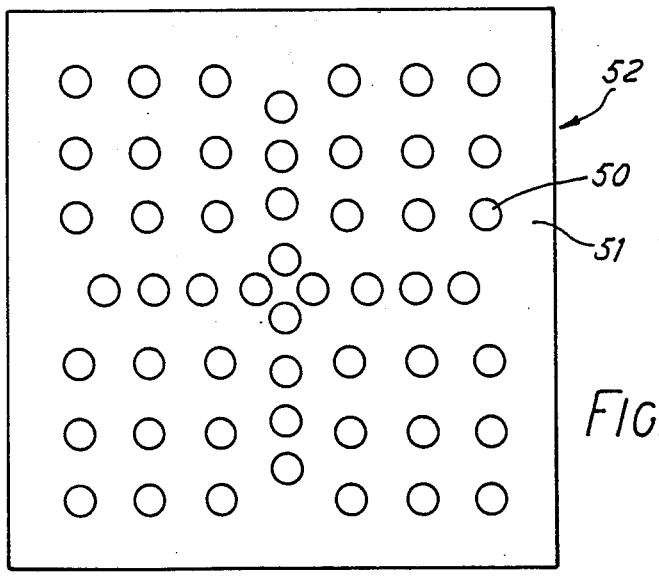

FIG. 7 is a plan view of the arrangement of helical elements 50 on an upper plate 5, for another form of antenna module 52. The particular arrangements of elements in the central cross region can provide an improved reception response, and especially a decrease in the sidelobe level and improvement in power gain.

In a modification, any of the modules described above have spiral antenna elements instead of at least some of the helical elements.

A module as described above can be used alone, or in an assembly of a number of such units whose output feeds are connected together in appropriate fashion.

I claim:

1. An antenna module comprising a resonant cavity having a major cross-section formed by first and second spaced apart and juxtaposed plate members with sidewalls linking said members, a plurality of antenna elements supported externally of the cavity and to one side of one of said first and second plate members, each antenna element having a probe portion coupled into said cavity through a respective aperture in said one side of one of said first and second plate members, wherein the shape in plan of said cavity conforms to a parallelogram at least one sidewall of which has an identation formed thereon in the form of a buttress extending into the cavity to an extent sufficient to promote the formation of standing waves of differing modes to that defined by the aforesaid parallelogram, for each buttress located on one sidewall there is positioned an opposing buttress on the parallel sidewall, thereby enhancing the frequency range of the said module.

2. An antenna module according to claim 1, wherein a buttress has a cross-section, in a plane parallel to the major cross-section of the cavity, substantially rectangular.

3. An antenna module according to claim 1, wherein a plurality of columns are located within the resonant cavity and between its two major surfaces, to effect division of the cavity into sections which enhance formation of predetermined wave modes.

4. An antenna module according claim 1, wherein a plurality of columns are located within the resonant cavity and between its two major surfaces, each column being at a position intermediate a pair of opposing buttresses on facing sides of the cavity.

5. An antenna module according to claim 1, wherein the antenna elements are arranged on the one side of one of said first and second plate members in a square matrix formation.

6. An antenna module according to claim 1, wherein the antenna elements are arranged on the one side of one of said first and second plate members in a rectangular matrix formation.

7. An antenna module according to claim 1, wherein the parallelogram shape of the major cross-section of the cavity is a square.

8. An antenna comprising a plurality of antenna modules according to claim 1 and feed means coupled to the antenna modules to effect electrical connection of the modules thereby to provide combined operation of the modules.

* * * * *